US008636892B2

(12) United States Patent
Koehl et al.

(10) Patent No.: US 8,636,892 B2
(45) Date of Patent: Jan. 28, 2014

(54) ANODE-CATHODE POWER DISTRIBUTION SYSTEMS AND METHODS OF USING THE SAME FOR ELECTROCHEMICAL REDUCTION

(75) Inventors: Eugene R. Koehl, Joliet, IL (US); Laurel A. Barnes, Chicago, IL (US); Stanley G. Wiedmeyer, Glen Ellyn, IL (US); Mark A. Williamson, Naperville, IL (US); James L. Willit, Batavia, IL (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 61 days.

(21) Appl. No.: 12/977,839

(22) Filed: Dec. 23, 2010

(65) Prior Publication Data

US 2012/0160703 A1 Jun. 28, 2012

(51) Int. Cl.
*C25C 3/00* (2006.01)
*C25C 5/04* (2006.01)

(52) U.S. Cl.
USPC ..... 205/560

(58) Field of Classification Search
USPC ..... 205/138, 96–97, 560; 204/230.7, 205, 204/243.1–247.4
See application file for complete search history.

(56) References Cited

U.S. PATENT DOCUMENTS

| | | | | |
|---|---|---|---|---|
| 422,139 | A | 2/1890 | Maxon | |
| 2,089,738 | A | 8/1935 | Elmer | |
| 2,800,219 | A | 7/1957 | Carroll | |
| 3,562,131 | A | 2/1971 | Jasberg | |
| 3,697,404 | A * | 10/1972 | Paige | 204/267 |
| 4,013,329 | A * | 3/1977 | Hugin | 439/33 |
| 4,039,403 | A | 8/1977 | Astley et al. | |
| 4,073,703 | A | 2/1978 | Kinosz et al. | |
| 4,203,531 | A | 5/1980 | Reichel et al. | |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

"Proceedings of GLOBAL 2005", Tsukuba, Japan, Oct. 9-13, 2005, Paper No. 488.

(Continued)

*Primary Examiner* — Luan Van
*Assistant Examiner* — Ho-Sung Chung
(74) *Attorney, Agent, or Firm* — Harness, Dickey & Pierce, P.L.C.

(57) ABSTRACT

Power distribution systems are useable in electrolytic reduction systems and include several cathode and anode assembly electrical contacts that permit flexible modular assembly numbers and placement in standardized connection configurations. Electrical contacts may be arranged at any position where assembly contact is desired. Electrical power may be provided via power cables attached to seating assemblies of the electrical contacts. Cathode and anode assembly electrical contacts may provide electrical power at any desired levels. Pairs of anode and cathode assembly electrical contacts may provide equal and opposite electrical power; different cathode assembly electrical contacts may provide different levels of electrical power to a same or different modular cathode assembly. Electrical systems may be used with an electrolyte container into which the modular cathode and anode assemblies extend and are supported above, with the modular cathode and anode assemblies mechanically and electrically connecting to the respective contacts in power distribution systems.

8 Claims, 6 Drawing Sheets

(56) References Cited

U.S. PATENT DOCUMENTS

| | | | | |
|---|---|---|---|---|
| 4,492,621 | A | 1/1985 | Stubb | |
| 4,668,353 | A | 5/1987 | Smith et al. | |
| 4,851,098 | A | 7/1989 | Kimura et al. | |
| 4,863,580 | A | 9/1989 | Epner | |
| 4,880,506 | A | 11/1989 | Ackerman et al. | |
| 5,415,742 | A | 5/1995 | La Camera et al. | |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,935,394 | A * | 8/1999 | Sivilotti et al. | 204/244 |
| 6,540,902 | B1 | 4/2003 | Redey et al. | |
| 6,689,260 | B1 | 2/2004 | Ahluwalia et al. | |
| 6,821,405 | B1 | 11/2004 | Marttila | |
| 6,866,768 | B2 | 3/2005 | Bradford et al. | |
| 7,090,760 | B2 | 8/2006 | Seo et al. | |
| 7,638,026 | B1 | 12/2009 | Willit et al. | |
| 7,799,185 | B1 | 9/2010 | Willit | |
| 2004/0007466 | A1 | 1/2004 | Seo et al. | |
| 2004/0134785 | A1 | 7/2004 | Gay et al. | |
| 2004/0168932 | A1 | 9/2004 | Wang | |
| 2005/0067291 | A1 | 3/2005 | Haiki et al. | |
| 2005/0205428 | A1 | 9/2005 | Dees et al. | |
| 2005/0233634 | A1 | 10/2005 | Kollmann | |
| 2007/0082551 | A1 | 4/2007 | Oesterhaus | |
| 2007/0295601 | A1 | 12/2007 | Bayer | |
| 2008/0128270 | A1 | 6/2008 | Hiraiwa et al. | |
| 2008/0152270 | A1 | 6/2008 | Engesser et al. | |
| 2009/0050483 | A1 | 2/2009 | Li | |
| 2009/0152124 | A1 * | 6/2009 | Ashford et al. | 205/574 |
| 2010/0276259 | A1 | 11/2010 | Phalen | |
| 2011/0180409 | A1 | 7/2011 | Willit et al. | |

FOREIGN PATENT DOCUMENTS

| | | | |
|---|---|---|---|
| DE | 26 00 344 | | 7/1977 |
| DE | 3837572 | | 5/1989 |
| DE | 19845258 | | 3/2000 |
| EP | 0 286 092 | | 10/1988 |
| EP | 0 736 929 | A1 | 10/1996 |
| EP | 2224542 | | 9/2010 |
| GB | 284678 | | 11/1928 |
| GB | 506590 | | 5/1939 |
| GB | 516775 | | 1/1940 |
| JP | H05279887 | | 10/1993 |
| JP | H0972991 | | 3/1997 |
| JP | 2006-308442 | | 11/2006 |
| WO | WO 02/066709 | | 8/2002 |
| WO | WO 2004/018737 | | 3/2004 |
| WO | 2004/031453 | A1 | 4/2004 |
| WO | WO 2005/035404 | | 4/2005 |
| WO | WO 2006/007863 | | 1/2006 |
| WO | WO 2009/062005 | | 5/2009 |
| WO | 2010/080761 | A1 | 7/2010 |

OTHER PUBLICATIONS

Jeong, et al., "Electrolytic production of metallic Uranium from U3O8 in a 20-kg batch scale reactor", Journal of Radioanalytical and Nuclear Chemistry, vol. 268, No. 2, pp. 349-356 (2006).

International Search Report dated Jan. 30, 2012 issued in PCT/US2011/053878.

International Search Report dated Feb. 6, 2012 issued in PCT/US2011/053872.

International Search Report dated Jan. 20, 2012 issued in PCT/US2011/053589.

Steven D. Herrman, et al., "Electrolytic Reduction of Spent Oxide Fuel—Bench-Scale Test Results", Global 2005, INL/CON-05-00304, Paper No. 488, Oct. 2005.

International Search Report issued in connection with PCT/US2011/05387, May 11, 2012.

International Search Report and Written Opinion issued in International Patent Application No. PCT/US2012/058664, mailed Jul. 8, 2013.

International Search Report and Written Opinion issued in International Patent Application No. PCT/US2012/058659, mailed Jul. 5, 2013.

International Search Report and Written Opinion issued in International Patent Application No. PCT/US2012/058661, mailed Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

International Search Report and Written Opinion issued in International Patent Application No. PCT/US2012/058663, issued Aug. 12, 2013.

International Search Report and Written Opinion issued in International Patent Application No. PCT/US2012/058531, issued Aug. 2, 2013.

European Search Report issued in European Patent Application No. 13163951.0, issued Aug. 29, 2013.

* cited by examiner

ANODE-CATHODE POWER DISTRIBUTION SYSTEMS AND METHODS OF USING THE SAME FOR ELECTROCHEMICAL REDUCTION

GOVERNMENT SUPPORT

This invention was made with Government support under contract number DE-AC02-06CH11357, awarded by the U.S. Department of Energy. The Government has certain rights in the invention.

BACKGROUND

Single and multiple-step electrochemical processes are useable to reduce metal-oxides to their corresponding metallic (unoxidized) state. Such processes are conventionally used to recover high purity metal, metals from an impure feed, and/or extract metals from their metal-oxide ores.

Multiple-step processes conventionally dissolve metal or ore into an electrolyte followed by an electrolytic decomposition or selective electro-transport step to recover unoxidized metal. For example, in the extraction of uranium from spent nuclear oxide fuels, a chemical reduction of the uranium oxide is performed at 650° C., using a reductant such as Li dissolved in molten LiCl, so as to produce uranium and $Li_2O$. The solution is then subjected to electro-winning, where dissolved $Li_2O$ in the molten LiCl is electrolytically decomposed to regenerate Li. The uranium metal is prepared for further use, such as nuclear fuel in commercial nuclear reactors.

Single-step processes generally immerse a metal oxide in molten electrolyte, chosen to be compatible with the metal oxide, together with a cathode and anode. The cathode electrically contacts the metal oxide and, by charging the anode and cathode (and the metal oxide via the cathode), the metal oxide is reduced through electrolytic conversion and ion exchange through the molten electrolyte.

Single-step processes generally use fewer components and/or steps in handling and transfer of molten salts and metals, limit amounts of free-floating or excess reductant metal, have improved process control, and are compatible with a variety of metal oxides in various starting states/mixtures with higher-purity results compared to multi-step processes.

SUMMARY

Example embodiments include power distribution systems useable in electrolytic reduction systems. Example embodiments may include several cathode and anode assembly electrical contacts that permit flexible modular assembly numbers and placement by using a standardized connection configuration. Cathode and anode assembly electrical contacts may be consecutively or alternately arranged. Example anode and cathode assembly electrical contacts may have an insulated fork shape to mechanically receive a knife-edge electrical contact from modular assemblies. Anode and cathode assembly contacts may include a seating assembly fixing the contacts into a larger reduction system at desired positions, with electrical power being provided via power cables attached to the assemblies.

Cathode and anode assembly electrical contacts in example systems may provide electrical power at any desired levels, including pairs of anode and cathode assembly electrical contacts providing equal and opposite electrical power. Similarly, different cathode assembly electrical contacts may provide different levels of electrical power, even if connected to a same modular cathode assembly. Example systems may include a bus bar providing a common electrical power to anode or cathode assembly contacts. Example methods may include providing any desired level of electrical power through the cathode and anode assembly electrical contacts so as to provide power to an electrolytic reduction system.

Example embodiment electrical systems may be used in combination with an electrolyte container holding an electrolyte into which the modular cathode and anode assemblies extend and are supported above, with the modular cathode and anode assemblies mechanically and electrically connecting to the respective contacts of example electrical systems. Modular anode assemblies may include an anode block into which an anode rod seats, a bus that electrically connects to the anode assembly electrical contacts, and a slip joint electrically coupling the anode block to the bus. The slip joint includes a plurality of lateral members that may expand under high temperatures while maintaining electrical contact with the anode block and bus.

DETAILED DESCRIPTION

Figure 1:
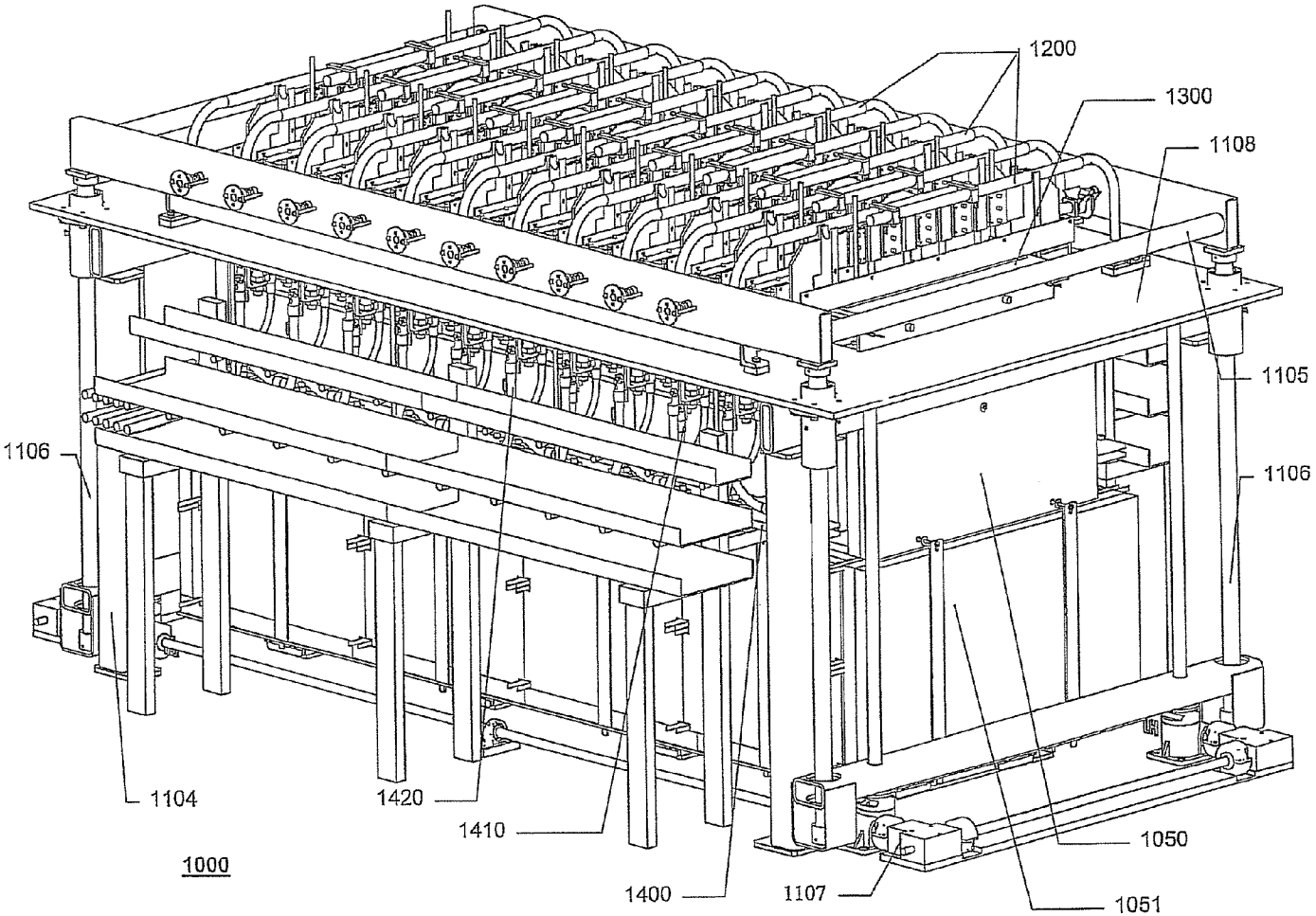
FIG. 1 is an illustration of an example embodiment electrolytic oxide reduction system.

Hereinafter, example embodiments will be described in detail with reference to the attached drawings. However, specific structural and functional details disclosed herein are merely representative for purposes of describing example embodiments. The example embodiments may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures or described in the specification. For example, two figures or steps shown in succession may in fact be executed in series and concurrently or may sometimes be executed in the reverse order or repetitively, depending upon the functionality/acts involved.

The inventors have recognized a problem in existing single-step electrolytic reduction processes that the known processes cannot generate large amounts of reduced, metallic products on a commercial or flexible scale, at least in part because of limited, static cathode size and configuration. Single step electrolytic reduction processes may further lack flexibility in configuration, such as part regularity and replaceability, and in operating parameters, such as power level, operating temperature, working electrolyte, etc. Example systems and methods described below uniquely address these and other problems, discussed below or not.

Example Embodiment Electrolytic Oxide Reduction Systems

FIG. 1 is an illustration of an example embodiment electrolytic oxide reduction system (EORS) 1000. Although aspects of example embodiment EORS 1000 are described below and useable with related example embodiment components, EORS 1000 is further described in the following co-pending applications:

| Serial No. | Filing Date | Attorney Docket No. |
|---|---|---|
| XX/XXX,XXX | Herewith | 24AR246135 (8564-000224) |
| XX/XXX,XXX | Herewith | 24AR246138 (8564-000226) |
| XX/XXX,XXX | Herewith | 24AR246139 (8564-000227) |
| XX/XXX,XXX | Herewith | 24AR246140 (8564-000228) |

The disclosures of the above-listed co-pending applications are incorporated by reference herein in their entirety.

As shown in FIG. 1, example embodiment EORS 1000 includes several modular components that permit electrolytic reduction of several different types of metal-oxides on a flexible or commercial scale basis. Example embodiment EORS 1000 includes an electrolyte container 1050 in contact with or otherwise heated by a heater 1051, if required to melt and/or dissolve an electrolyte in container 1050. Electrolyte container 1050 is filled with an appropriate electrolyte, such as a halide salt or salt containing a soluble oxide that provides mobile oxide ions, chosen based on the type of material to be reduced. For example, $CaCl_2$ and CaO, or $CaF_2$ and CaO, or some other Ca-based electrolyte, or a lithium-based electrolyte mixture such as LiCl and $Li_2O$, may be used in reducing rare-earth oxides, or actinide oxides such as uranium or plutonium oxides, or complex oxides such as spent nuclear fuel. The electrolyte may further be chosen based on its melting point. For example, an electrolyte salt mixture of LiCl and $Li_2O$ may become molten at around 610° C. at standard pressure, whereas a $CaCl_2$ and CaO mixture may require an operating temperature of approximately 850° C. Concentrations of the dissolved oxide species may be controlled during reduction by additions of soluble oxides or chlorides by electrochemical or other means.

EORS 1000 may include several supporting and structural members to contain, frame, and otherwise support and structure other components. For example, one or more lateral supports 1104 may extend up to and support a top plate 1108, which may include an opening (not shown) above electrolyte container 1050 so as to permit access to the same. Top plate 1108 may be further supported and/or isolated by a glove box (not shown) connecting to and around top plate 1108. Several standardized electrical contacts 1480 (FIG. 2) and cooling sources/gas exhausts may be provided on or near top plate 1108 to permit anode and cathode components to be supported by and operable through EORS 1000 at modular positions. A lift basket system, including a lift bar 1105 and/or guide rods 1106 may connect to and/or suspend cathode assemblies 1300 that extend down into the molten electrolyte in electrolyte container 1050. Such a lift basket system may permit selective lifting or other manipulation of cathode assemblies 1300 without moving the remainder of EORS 1000 and related components.

In FIG. 1, EORS 1000 is shown with several cathode assemblies 1300 alternating with several anode assemblies 1200 supported by various support elements and extending into electrolyte container 1050. The assemblies may further be powered or cooled through standardized connections to corresponding sources in EORS 1000. Although ten cathode assemblies 1300 and eleven anode assemblies 1200 are shown in FIG. 1, any number of anode assemblies 1200 and cathode assemblies 1300 may be used in EORS 1000, depending on energy resources, amount of material to be reduced, desired amount of metal to be produced, etc. That is, individual cathode assemblies 1300 and/or anode assemblies 1200 may be added or removed so as to provide a flexible, and potentially large, commercial-scale, electrolytic reduction system. In this way, through the modular design of example embodiment EORS 1000, anode assemblies 1200 and cathode assemblies 1300, example embodiments may better satisfy material production requirements and energy consumption limits in a fast, simplified single-stage reduction operation. The modular design may further enable quick repair and standardized fabrication of example embodiments, lower manufacturing and refurbishing costs and time consumption.

Figure 2:
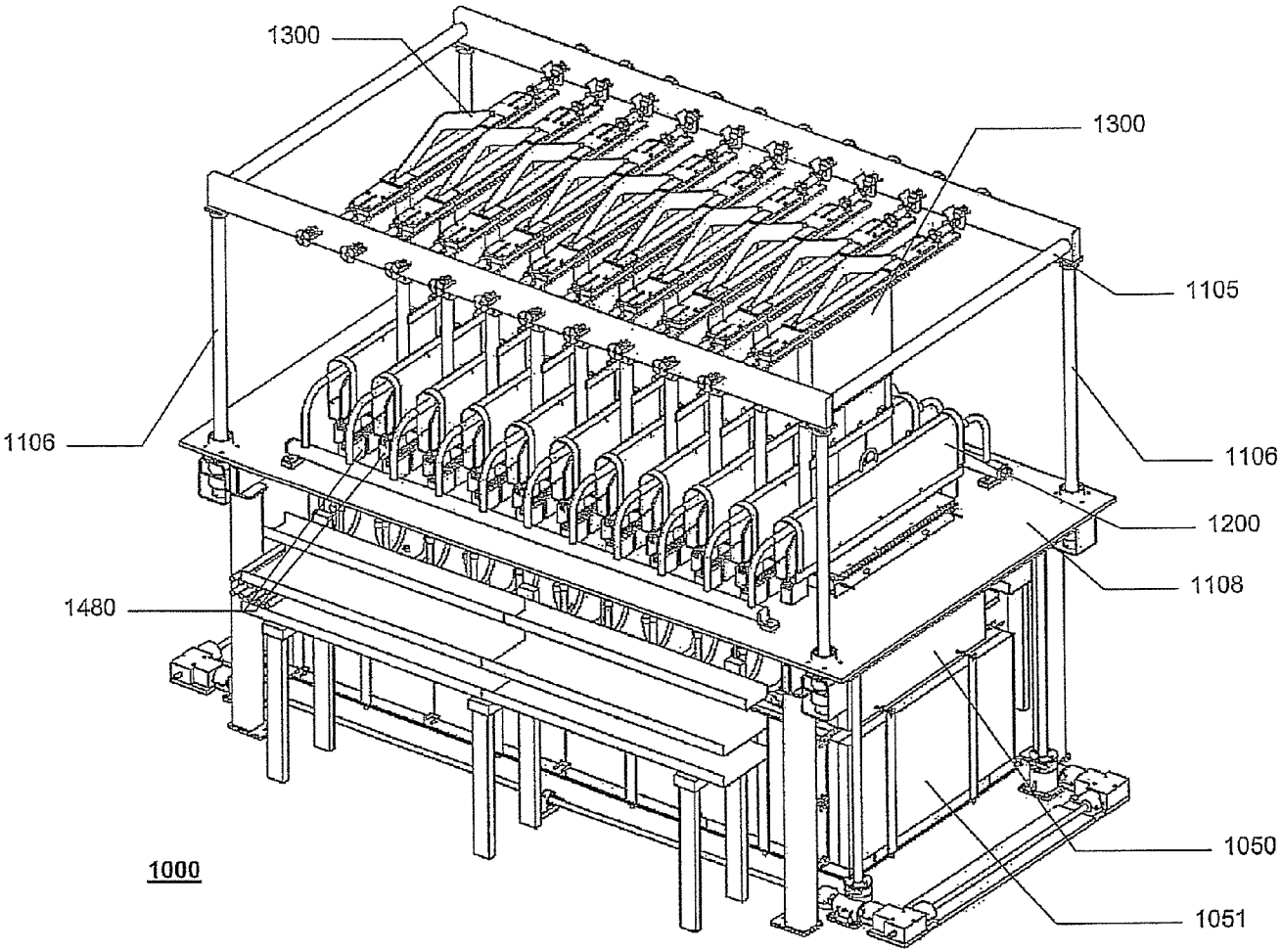
FIG. 2 is another illustration of the example embodiment electrolytic oxide reduction system of FIG. 1 in an alternate configuration.

FIG. 2 is an illustration of EORS 1000 in an alternate configuration, with basket lifting system including lift bar 1105 and guide rods 1106 raised so as to selectively lift only modular cathode assemblies 1300 out of electrolyte container 1050 for access, permitting loading or unloading of reactant metals oxides or produced reduced metals from cathode assemblies 1300. In the configuration of FIG. 2, several modular electrical contacts 1480 are shown aligned at modular positions about the opening in top plate 1108. For example, electrical contacts 1480 may be knife-edge contacts that permit several different alignments and positions of modular cathode assemblies 1300 and/or anode assemblies 1200 within EORS 1000.

As shown in FIG. 1, a power delivery system including a bus bar 1400, anode power cable 1410, and/or cathode power cable 1420 may provide independent electric charge to anode assemblies 1200 and/or cathode assemblies 1300, through electrical contacts (not shown). During operation, electrolyte in electrolyte container 1050 may be liquefied by heating and/or dissolving or otherwise providing a liquid electrolyte material compatible with the oxide to be reduced. Operational temperatures of the liquefied electrolyte material may range from approximately 400-1200° C., based on the materials used. Oxide material, including, for example, $Nd_2O_3$, $PuO_2$, $UO_2$, complex oxides such as spent oxide nuclear fuel or rare earth ores, etc., is loaded into cathode assemblies 1300, which extend into the liquid electrolyte, such that the oxide material is in contact with the electrolyte and cathode assembly 1300.

The cathode assembly 1300 and anode assembly 1200 are connected to power sources so as to provide opposite charges or polarities, and a current-controlled electrochemical process occurs such that a desired electrochemically-generated reducing potential is established at the cathode by reductant electrons flowing into the metal oxide at the cathode. Because of the generated reducing potential, oxygen in the oxide material within the cathode assemblies 1300 is released and dissolves into the liquid electrolyte as an oxide ion. The reduced metal in the oxide material remains in the cathode assembly 1300. The electrolytic reaction at the cathode assemblies may be represented by equation (1):

$$\text{(Metal Oxide)}+2e^{-}\rightarrow\text{(reduced Metal)}+O^{2-} \quad (1)$$

where the $2e^{-}$ is the current supplied by the cathode assembly 1300.

At the anode assembly 1200, negative oxygen ions dissolved in the electrolyte may transfer their negative charge to the anode assembly 1200 and convert to oxygen gas. The electrolysis reaction at the anode assemblies may be represented by equation (2):

$$2O^{2-}\rightarrow O_2+4e^{-} \quad (2)$$

where the $4e^{-}$ is the current passing into the anode assembly 1200.

If, for example, a molten Li-based salt is used as the electrolyte, cathode reactions above may be restated by equation (3):

$$\text{(Metal Oxide)}+2e^{-}+2Li^{+}\rightarrow\text{(Metal Oxide)}+2Li\rightarrow\text{(reduced Metal)}+2Li++O^{2-} \quad (3)$$

However, this specific reaction sequence may not occur, and intermediate electrode reactions are possible, such as if cathode assembly 1300 is maintained at a less negative potential than the one at which lithium deposition will occur. Potential intermediate electrode reactions include those represented by equations (4) and (5):

$$\text{(Metal Oxide)}+xe^{-}+2Li^{+}\rightarrow Li_x\text{(Metal Oxide)} \quad (4)$$

$$Li_x\text{(Metal Oxide)}+(2-x)e^{-}+(2-x)Li^{+}\rightarrow\text{(reduced Metal)}+2Li^{+}+O^{2-} \quad (5)$$

Incorporation of lithium into the metal oxide crystal structure in the intermediate reactions shown in (4) and (5) may improve conductivity of the metal oxide, favoring reduction.

Reference electrodes and other chemical and electrical monitors may be used to control the electrode potentials and rate of reduction, and thus risk of anode or cathode damage/corrosion/overheating/etc. For example, reference electrodes may be placed near a cathode surface to monitor electrode potential and adjust voltage to anode assemblies 1200 and cathode assemblies 1300. Providing a steady potential sufficient only for desired reduction reactions may avoid anode reactions such as chlorine evolution and cathode reactions such as free-floating droplets of electrolyte metal such as lithium or calcium.

Efficient transport of dissolved oxide-ion species in a liquid electrolyte, e.g. $Li_2O$ in molten LiCl used as an electrolyte, may improve reduction rate and unoxidized metal production in example embodiment EORS 1000. Alternating anode assemblies 1200 and cathode assemblies 1300 may improve dissolved oxide-ion saturation and evenness throughout the electrolyte, while increasing anode and cathode surface area for larger-scale production. Example embodiment EORS 1000 may further include a stirrer, mixer, vibrator, or the like to enhance diffusional transport of the dissolved oxide-ion species.

Chemical and/or electrical monitoring may indicate that the above-described reducing process has run to completion, such as when a voltage potential between anode assemblies 1200 and cathode assemblies 1300 increases or an amount of dissolved oxide ion decreases. Upon a desired degree of completion, the reduced metal created in the above-discussed reducing process may be harvested from cathode assemblies 1300, by lifting cathode assemblies 1300 containing the retained, reduced metal out of the electrolyte in container 1050. Oxygen gas collected at the anode assemblies 1200 during the process may be periodically or continually swept away by the assemblies and discharged or collected for further use.

Although the structure and operation of example embodiment EORS 1000 has been shown and described above, it is understood that several different components described in the incorporated documents and elsewhere are useable with example embodiments and may describe, in further detail, specific operations and features of EORS 1000. Similarly, components and functionality of example embodiment EORS 1000 is not limited to the specific details given above or in the incorporated documents, but may be varied according to the needs and limitations of those skilled in the art.

Example Embodiment Power Distribution Systems

Figure 3:
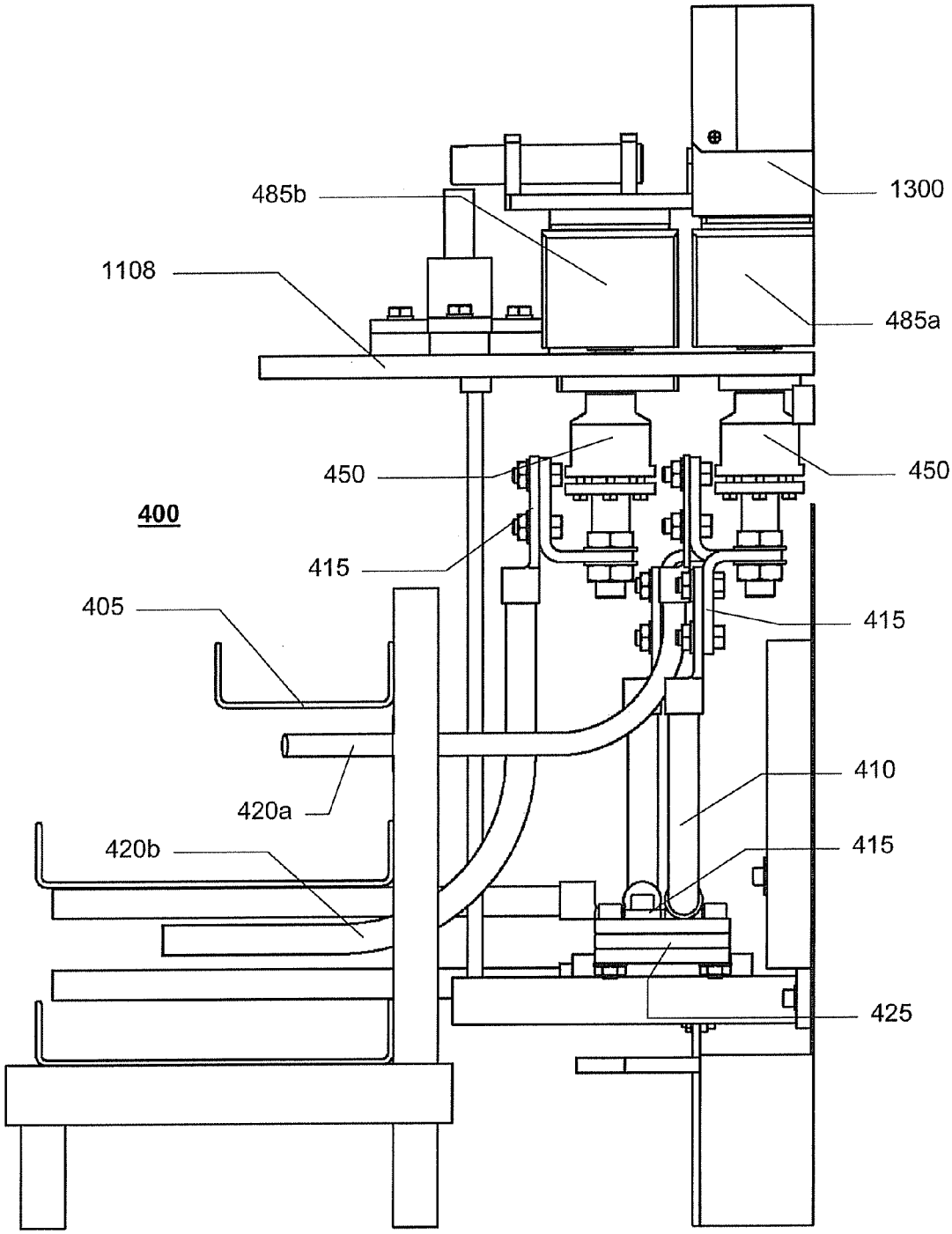
FIG. 3 is an illustration of an example embodiment electrical power distribution system.
Figure 4:
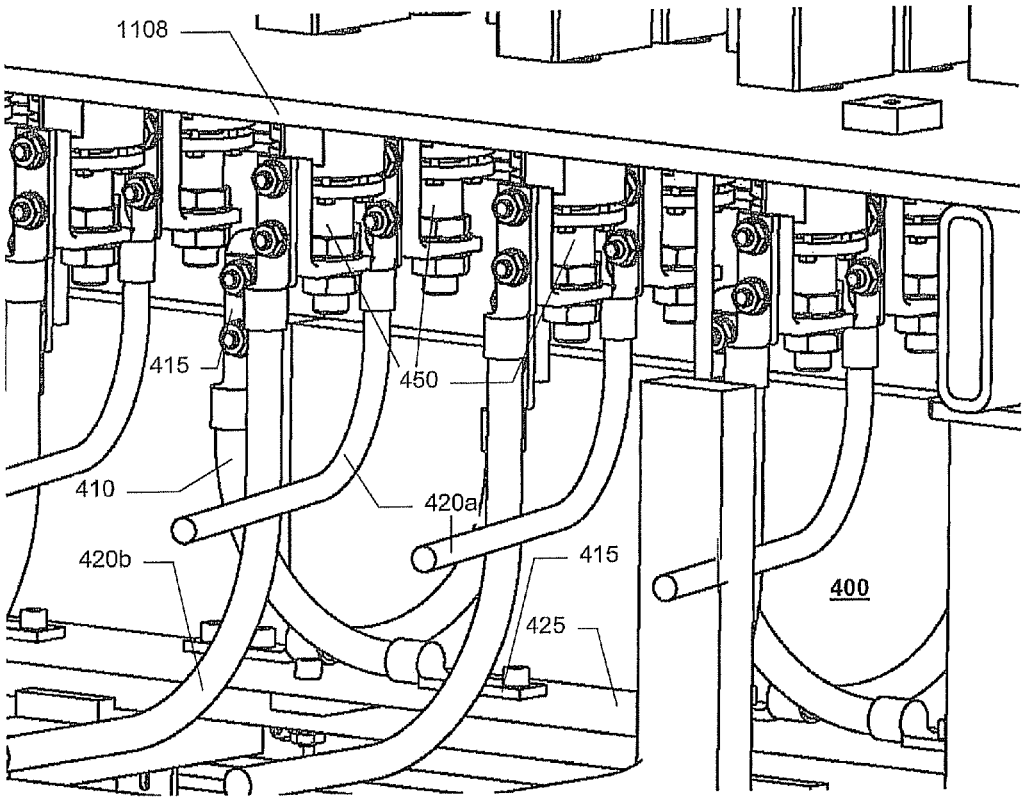
FIG. 4 is an illustration of another view of the example embodiment electrical power distribution system of FIG. 3.
Figure 5:
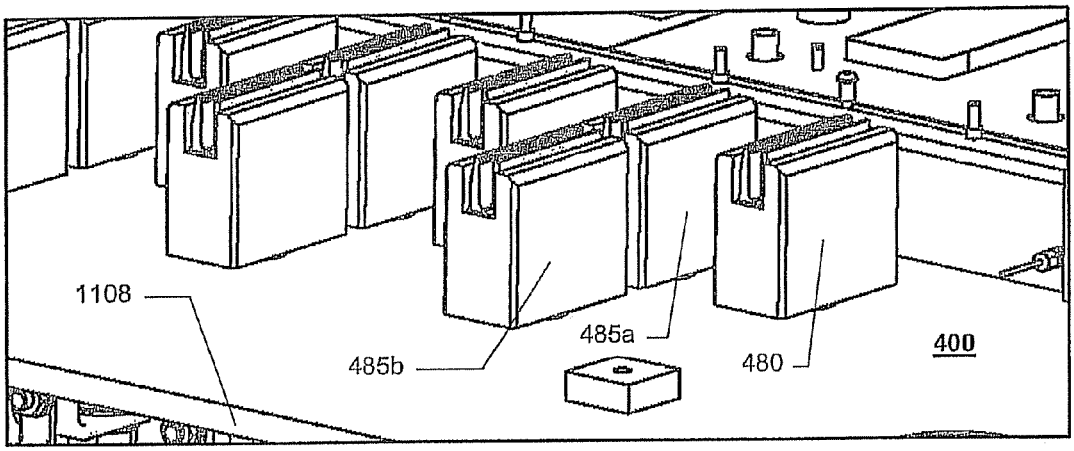
FIG. 5 is an illustration of a detail of example embodiment cathode assembly contacts and anode assembly contacts.

FIGS. 3 and 4 are illustrations of example embodiment power distribution system 400, with FIG. 3 being a profile schematic view and FIG. 4 being an isometric view of system 400. Example embodiment system 400 is illustrated with components from and as useable with EORS 1000 (FIGS. 1-2); however, it is understood that example embodiments are useable in other electrolytic reduction systems. Similarly, while one example system 400 is shown in FIGS. 3-5, it is understood that multiple example systems 400 are useable with electrolytic reduction devices. In EORS 1000 (FIGS. 1-2), for example, multiple power distribution systems may be used on each side of EORS 1000 to provide balanced electrical power to several modular anode and/or cathode assemblies.

As shown in FIG. 3, example embodiment power distribution system 400 includes a plurality of cathode assembly contacts 485 where a modular cathode assembly, such as modular cathode assembly 1300, may mechanically and electrically connect and receive electrical power. Cathode assembly contacts 485 may be a variety of shapes and sizes, including standard plugs and/or cables, or, in example system 400, fork-type contacts that are shaped to receive knife-edge connections from example cathode assemblies 1300. For example, cathode assembly contacts 485*a* and 485*b* may include a fork-type conductive contact surrounded by an insulator, so as to reduce a risk of accidental electrical contact. Each cathode assembly contact 485*a* and 485*b* may be seated in top plate 1108 at any position(s) desired to be available to modular cathode assemblies.

Cathode assembly contacts 485*a* and 485*b* may provide different levels of electrical power, voltage, and/or current from each other. For example, contact 485*b* may provide higher power, matching the levels provided through anode contacts 480 (FIG. 5) discussed below, with opposite polarity from anode contacts 480. Contact 485*a* may provide lower secondary power, through lesser and opposite voltage and/or current, compared to contact 485*b*; that is, the polarity of contact 485*a* may match that of anode contact 480 (FIG. 5) but at a lower level. In this way, opposite and variable electrical power may be provided to a single cathode assembly contacting cathode assembly contacts 485*a* and 485*b*. Additionally, both primary and secondary levels of power may be provided through contact 485*b*, or any other desired or variable level of power for operating example reduction systems.

Each cathode assembly contact 485*a* and 485*b* may be parallel and aligned with other contacts on an opposite side of reduction systems, so as to provide a planar, thin-profile electrical contact area for modular cathode assemblies connecting thereto. Alternately, cathode assembly contacts 485*a* and 485*b* may be staggered or placed in alternate positions to match different cathode assembly electrical connector configurations. By repetitive, flexible positioning, variable electrical supply, and standardized design, cathode assembly contacts 485*a* and 485*b* permit modular and commercial scaling in modular cathode assembly use. In this way, example embodiment power distribution system 400 permits selective addition, removal, repositioning, and powering of cathode assemblies in electrolytic reduction systems.

FIG. 5 is an illustration of a detail of cathode assembly contacts 485*a* and 485*b*, and anode assembly contacts 480 above top plate 1108 in an example embodiment power distribution system 400 useable with EORS 1000 (FIGS. 1 and 2). As shown in FIG. 5, anode assembly contact 480 may be substantially similar to cathode assembly contacts 485*a* and 485*b* discussed above, with insulating covers surrounding fork-type contacts configured to mechanically and electrically connect to knife-edge connections from a modular anode assembly 1200 (FIG. 1), for example. Anode assembly contact 480 may also be positioned on either side of example reducing systems at positions available for modular anode assembly occupancy. For example, as shown in FIG. 5, anode assembly contacts 480 may be staggered alternately with cathode assembly contacts 485. Several other configurations are equally possible, including single or plural anode assembly contacts 480 placed sequentially or alternately at any desired position for modular anode assembly power delivery. By flexible positioning and/or standardized design, anode assembly contacts 480 permit modular and commercial scaling in modular anode assembly use. Example embodiment power distribution system 400 including anode assembly contacts 480 permits selective addition, removal, repositioning, and powering of anode assemblies in electrolytic reduction systems.

As shown in FIGS. 3 and 4, each contact 480, 485*a*, and 485*b* may be independently powered in example embodiment power distribution system 400, such that each contact provides a desired electrical power, voltage, and/or current level and thus reducing potential to a reducing system. Contacts 480, 485*a*, 485*b*, etc. may include an insulated seating assembly 450 that passes through and positions the contacts within top plate 1108 or any other structure. Seating assemblies 450 may connect to fork-type connectors or any other terminal in anode or cathode contacts and may also connect to an electrical connector 415 providing electrical power to the seating assembly 450. Electrical connector 415 may be any type of electrical interface, including, for example, a fastened conductive lead arrangement as shown in FIGS. 3 and 4, a spliced wire, and/or a plug-and-receptor type of interface.

Power cables 410, 420*a*, and 420*b* may be connected to electrical connectors 415 so as to provide desired electrical power to seating assemblies 450 and contacts 480, 485*a*, and 485*b*, respectively. Power cables 410, 420*a*, and 420*b* may be any type or capacity of line based on the level of power desired to deliver to electrical contacts 480, 485*a*, 485*b*, respectively, in example embodiment power distribution system 400. Power cables 410, 420*a*, and 420*b* may connect to any shared or independent power source for operating reducing systems. For example, power cables 420*a* and 420*b* may connect to adjustable power sources providing variable electrical characteristics to power cables 420*a* and 420*b*, while power lines 410 may each connect to a shared bus bar 425 providing an equal current and/or voltage to power cables 410. For example, bus bar 425 may connect to a single power source and each power cable 410 on a given side of EORS 1000. One or more trays 405 on an external portion of reducing devices may separate and/or organize individual power cables 410, 420*a*, and 420*b*.

Because individual electrical contacts 480, 485*a*, 485*b* may have electrical power provided from individual sources in example embodiment power delivery system 400, it is possible to operate reducing systems including example embodiment power delivery system 400 with different electrical characteristics between each modular anode and cathode assembly. For example, cables 410 and 420*b*, delivering power to anode contact 480 and cathode contact 485*b*, respectively, may be operated at equal and opposite higher power/polarity. Modular cathode assemblies 1300 and anode assemblies 1200 connected to their respective contacts 485*b* and 480 may thus operate at equal power levels and provide a balanced reducing potential. That is, a circuit may be completed between modular cathode and anode assemblies such that substantially equal current flows into 420*b* and out of 410 (depending on electrical current perspective). Electricity to power cables 420*a* may be provided at a secondary power level (2.3 V and 225 A, for example), while power cables 410 or 420*b* may be provided with primary level power (2.4 V and 950 A, for example) at opposite polarities. The polarity of power provided to power cables 420*a* may be the same as that provided to power cables 410 and opposite that provided to 420*b*. In this way, cathode assembly contacts 485*a* and 485*b* may provide different or opposite power levels to modular cathode assemblies connected thereto, for components of modular cathode assemblies that may use different electrical power levels. Matching or varied electrical systems on an opposite side of electrolytic reducing systems may be operated in similar or different manners to provide electrical power to modular assemblies having multiple electrical contacts. Table 1 below shows examples of power supplies for each contact and power line thereto, with the understanding that any of contacts 480, 485*a*, and 485*b* may provide different individualized power levels and/or opposite polarities.

TABLE 1

| Power Level (Polarity) | Via Cable | Contact | For Electrode |
|---|---|---|---|
| Primary (+) | 410 | 480 | Anode Assembly |
| Primary (−) or Secondary (−) | 420b | 485b | Cathode Assembly (−) |
| Secondary (+) | 420a | 485a | Cathode Assembly (+) |

Because individual electrical contacts 480, 485*a*, 485*b* may have electrical power provided from individual sources in example embodiment power delivery system 400, it is possible to operate reducing systems including example embodiment power delivery system 400 with different electrical characteristics between each modular anode and basket assembly. For example, cables 420*a* and 420*b*, delivering power to cathode assembly contact 485*a* and cathode assembly contact 485*b*, respectively, may be operated at opposite polarities and act as a secondary circuit within a cathode assembly 1300, to condition the electrolyte. Similarly, contacts 485*a* and 485*b* may be reversed, such that contact 485*b* provides a secondary anode power level to a cathode basket and contact 485*a* provides a primary cathode power level to a cathode plate. Modular cathode assemblies 1300 and anode assemblies 1200 may be provided primary power levels through respective contacts 485*a* or 485*b* and 480 sufficient to reduce material contained in the cathode assembly 1300. Matching or varied electrical systems on an opposite side of electrolytic reducing systems may be operated in similar or different manner to provide electrical power to modular assemblies having multiple electrical contacts.

Figure 6:
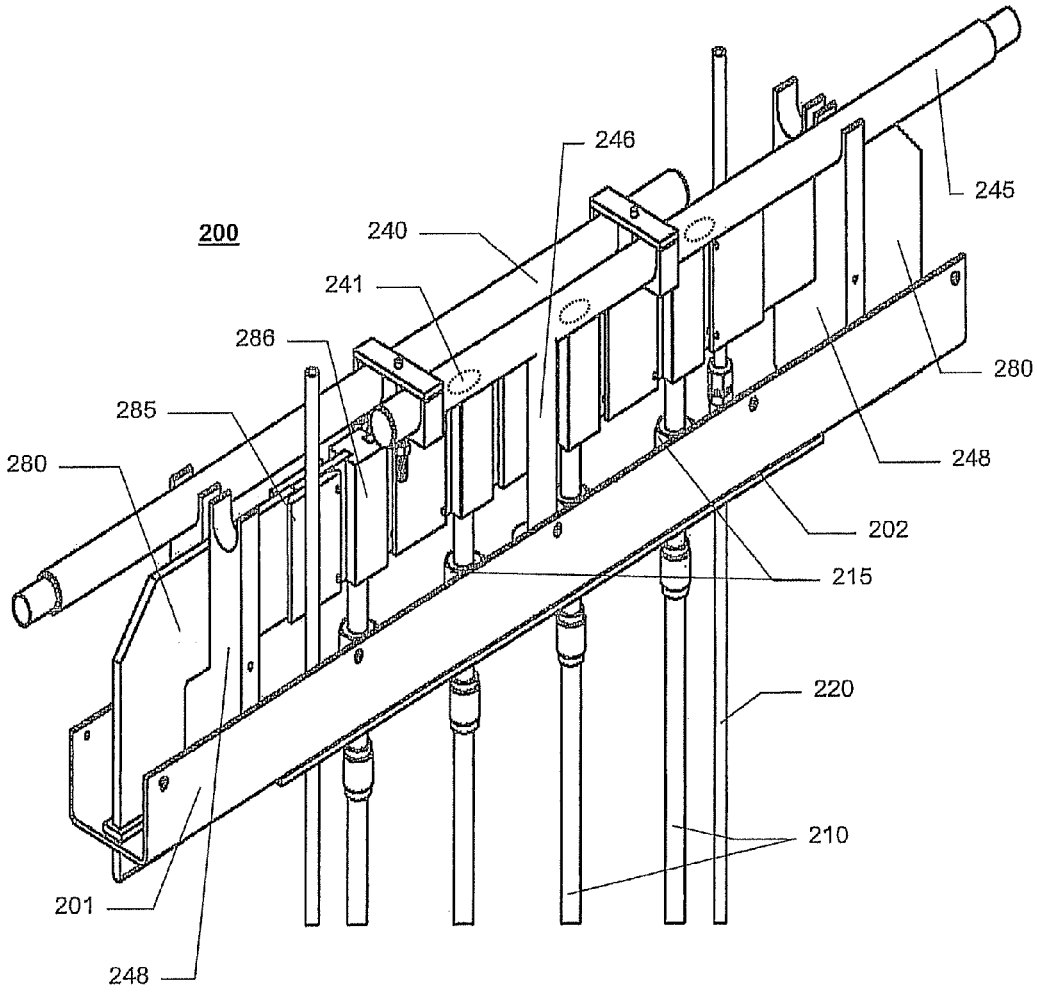
FIG. 6 is an illustration of an example embodiment anode assembly.

FIG. 6 is an illustration of an example embodiment anode assembly 200, showing electrical internal components useable therein and with example embodiment power distribution system 400. Anode rod 210, regardless of its position or orientation within assembly 200, is electrically powered by an electrical system of example embodiment modular anode assembly 200. For example, an electrical system may include an anode block 286, slip connection 285, and bus 280, that provides current and/or voltage to one or more anode rods 210. In the example shown in FIG. 6, anode rod 210 connects or seats into an insert or hole in anode block 286 so as to maximize surface area contact between anode block 286 and anode rod 210. Anode block 286 is electrically connected through lateral contacts at a slip connection 285 to bus 280. Anode block 286, slip connection 285, and bus 280 may each be insulated from and/or otherwise not electrically connected to channel frame 201 and anode guard (not shown). For example, as shown in FIG. 6, slip connection 285, anode block 286, and bus 280 are each elevated from and separated from channel frame 201. Where these elements contact other charged components, such as anode rods 210 joining to anode block 286 at channel frame 201 or where knife-edge contacts of bus 280 extends through channel frame 201, an insulator may be interposed between the contact and channel frame 201.

Slip connection 285 permits thermal expansion of anode block 286 and/or bus 280 without movement of anode rod 210 or resulting damage. That is, anode block 286 and/or bus 280 may expand and/or contract transversely past each other in slip connection 285, while still remaining in lateral electrical contact. Each component of the example electrical system is fabricated of electrically-conductive material, such as copper or iron alloys and the like. Any number of components may repeat within the electrical system, for example, several anode blocks 286 may be positioned to connect to several corresponding anode rods 210 while still each connecting to plural busses 280 at either end of example embodiment modular anode assembly 200, which may connect to corresponding synchronized voltage sources in the form of anode contacts 480 (FIGS. 3-5).

An electrical system insulated from channel frame 201 and anode guard (not shown) may be nonetheless connected to an external electrical source 480 (FIGS. 3-5). For example, bus 280 may include a knife-edge contact extending through, and insulated from, channel frame 201. The knife-edge contact of bus 280 may seat into a knife-edge receptor, such as fork-type electrical connector in anode assembly contacts 480 at defined positions where example embodiment modular anode assembly 200 may be placed. Independent electrical current and/or voltage of desired levels may be provided to anode rod 210 through bus 280, slip connection 285, and anode block 286, so that anode rods 210 may provide an oxidizing potential/oxide ion oxidation to oxygen gas in a reducing system. Voltage and/or current provided by an electrical system in example embodiment assemblies 200 may be varied by power supplied to example embodiment system 400 (FIGS. 3-5), manually or automated, based on physical parameters of a system and feedback from instrumentation, which may also be provided by example embodiment anode assembly 200.

A desired power level, measured in either current or voltage, is applied to anode assemblies through an electrical system in the assemblies so as to charge anode rods therein in example methods. This charging, while the anode rods are contacted with an electrolyte, reduces a metal oxide in nearby cathodes or in contact with the same in the electrolyte, while oxidizing oxide ions dissolved into the electrolyte. Example methods may further swap modular parts of assemblies or entire assemblies within reduction systems based on repair or system configuration needs, providing a flexible system that can produce variable amounts of reduced metal and/or be operated at desired power levels, electrolyte temperatures, and/or any other system parameter based on modular configuration. Following reduction, the reduced metal may be removed and used in a variety of chemical processes based on the identity of the reduced metal. For example, reduced uranium metal may be reprocessed into nuclear fuel.

Example embodiments thus being described, it will be appreciated by one skilled in the art that example embodiments may be varied through routine experimentation and without further inventive activity. For example, although electrical contacts are illustrated in example embodiments at one side of an example reducing system, it is of course understood that other numbers and configurations of electrical contacts may be used based on expected cathode and anode assembly placement, power level, necessary anodizing potential, etc. Variations are not to be regarded as departure from the spirit and scope of the example embodiments, and all such modifications as would be obvious to one skilled in the art are intended to be included within the scope of the following claims.

What is claimed is:

1. An electrolytic oxide reduction system, comprising:

an electrolyte container containing an electrolyte;

at least one modular cathode assembly supported above the electrolyte container and extending into the electrolyte;

at least one modular anode assembly on a side of the modular cathode assembly;

a plurality of cathode assembly electrical contacts, each of the cathode assembly electrical contacts having a same physical configuration permitting mechanical and electrical connection with the at least one modular cathode assembly; and a plurality of anode assembly electrical contacts, each of the anode assembly electrical contacts having a same physical configuration permitting mechanical and electrical connection with the at least one modular anode assembly;

wherein the plurality of cathode assembly contacts include at least two cathode assembly contacts configured to electrically connect to a same modular cathode assembly, the system configured such that the at least two cathode assembly contacts provide different electrical power levels.

2. The system of claim 1, wherein the system is configured such that at least one of the cathode assembly electrical contacts and a corresponding one of the anode assembly electrical contacts provide equal and opposite electrical power to the modular anode assembly and the modular cathode assembly.

3. The system of claim 1, wherein the modular anode assembly includes, an anode block into which an anode rod seats and is electrically connected, a bus providing electrical power to the anode block, and a slip joint electrically coupling the anode block to the bus.

4. The system of claim 3, wherein the bus includes a knife-edge contact extending from the modular anode assembly channel frame so as to electrically and mechanically connect to one of the anode assembly electrical contacts.

5. The system of claim 3, wherein the slip joint includes a plurality of lateral members moveable in a first direction with respect to each other lateral member while remaining in electrical contact with at least one other lateral member in a second direction.

6. The system of claim 1, wherein the plurality of cathode assembly electrical contacts and the plurality of anode assembly electrical contacts have a fork shape to mechanically receive a knife-edge electrical contact from one of the modular anode assemblies and one of the modular cathode assemblies, respectively.

7. The system of claim 1, wherein the plurality of cathode assembly electrical contacts includes a first cathode assembly contact and a second cathode assembly contact, the first cathode assembly contact being electrically connected to a first power source, the second cathode assembly contact being connected to a second power source, the first power source being independent of the second power source.

8. The system of claim 1, wherein the plurality of cathode assembly electrical contacts and the plurality of anode assembly electrical contacts include two cathode assembly contacts for each anode assembly contact.

* * * * *